US006330818B1

(12) United States Patent
Jain

(10) Patent No.: US 6,330,818 B1
(45) Date of Patent: Dec. 18, 2001

(54) LUBRICATION SYSTEM FOR METALFORMING

(75) Inventor: Sulekh Chand Jain, Sugar Land, TX (US)

(73) Assignee: Materials and Manufacturing Technologies Solutions Company, Montgomery, OH (US)

( * ) Notice: Subject to any disclaimer, the term of this patent is extended or adjusted under 35 U.S.C. 154(b) by 0 days.

(21) Appl. No.: 09/596,538

(22) Filed: Jun. 16, 2000

Related U.S. Application Data

(63) Continuation-in-part of application No. 09/213,552, filed on Dec. 17, 1998, now abandoned.

(51) Int. Cl.[7] ..... B21J 3/00
(52) U.S. Cl. ..... 72/42; 72/43
(58) Field of Search ..... 72/39, 40, 72, 72/42, 43, 46, 47; 106/109

(56) References Cited

U.S. PATENT DOCUMENTS

| | | | | |
|---|---|---|---|---|
| 2,926,138 | | 2/1960 | Huet | 252/30 |
| 3,556,255 | | 1/1971 | Lomax, Jr. | 184/1 |
| 3,992,558 | * | 11/1976 | Smith-Johannsen et al. | 427/213 |
| 3,995,979 | | 12/1976 | Fedrigo | 425/78 |
| 4,052,323 | | 10/1977 | Feneberger et al. | 252/23 |
| 4,287,073 | | 9/1981 | Jain et al. | 252/30 |
| 5,089,154 | * | 2/1992 | King | 252/28 |
| 5,495,737 | | 3/1996 | Graham | 72/42 |
| 5,682,591 | | 10/1997 | Inculet et al. | 419/38 |
| 5,691,282 | | 11/1997 | Periard et al. | 508/113 |

FOREIGN PATENT DOCUMENTS 57-159893 * 10/1982 (JP) .

* cited by examiner

*Primary Examiner*—Lowell A. Larson
(74) *Attorney, Agent, or Firm*—Bruce P. Bardes

(57) ABSTRACT

A system for applying metalworking lubricants to working surfaces of tools, dies and/or workpieces prior to forming said workpiece in a metal forming operation, particularly forging, is described. The system comprises lubricant particles, each comprising a lubricant coated with a protective surface having poor electrical conductivity, and electrostatic deposition means for applying such particles to working surfaces of tools and/or dies, or to the workpiece.

20 Claims, 1 Drawing Sheet

LUBRICATION SYSTEM FOR METALFORMING

This Application is a Continuation-in-Part of application Ser. No. 09/213,552, filed Dec. 17, 1998, now abandoned.

BACKGROUND OF THE INVENTION

1. Field of the Invention

The invention relates to an improved system for lubricating the interface between a metallic workpiece and the metalforming tooling used to alter the shape of said workpiece. In particular, the invention relates to an improved system for lubricating that interface in forging operations.

2. Background Art

It is well known in the metalforming arts that some sort of lubrication in the interface between a metallic workpiece and the metalforming tooling used to alter the shape of said workpiece is important for effective metalforming. Such lubricants facilitate the sliding of the workpiece material over the surface of the tooling, which helps the workpiece to conform the shape of the working surfaces of the tooling, and improves the metallurgical structure of the finished workpiece. Lubricants reduce wear on the tooling caused by flow of the workpiece material over the tooling. Lubricants alleviate the sticking of the workpiece to the tooling, thereby facilitating removal of a formed workpiece from the tooling. Lubricants also reduce the likelihood of damaging the surface of the workpiece by scoring, or forming grooves or scratches in the workpiece.

A wide range of lubricants has been employed for various types of metalworking operations. Some of the common lubricants are hydrocarbons and/or chemically modified hydrocarbons ranging in viscosity from light oils to thick greases, polymeric materials, soap-like substances, graphite and similar flake-like substances, and glasses. For convenience in application, these active substances may be used in conjuction with some sort of vehicle or solvent. Various additives such as wetting agents, suspension agents, thickeners or biocides may also be employed. In some cases, a precursor material is applied to the surface of the workpiece or the tooling, and it transforms to another material as a result of thermal decomposition or chemical reaction; the latter material is the actual lubricant. Factors that affect the choice of lubricant include the alloy composition of the workpiece, the physical dimensions of the workpiece, the nature of the metalforming operation, the temperature at which the metalforming operation is to be performed, and cost of the lubricant. Reactivity of the lubricant with either the workpiece material or the forging die must also be considered.

Similarly, a wide range of methods of applying metalforming lubricants has also been employed. In some methods, the lubricant is applied to the workpiece to be reshaped during the metalworking operation. In other methods, the lubricant is applied to working surfaces of the tooling used to effect the changes in shape. Some of the methods employed for applying lubricants are brushing, swabbing, spraying, dipping and electrostatic deposition. Most of these methods are facilitated by dissolving or suspending the lubricant hi some sort of low-viscosity vehicle, which allows the lubricant to be readily spread over the surface to which it is applied. Factors that affect the choice of application method include the choice of lubricant, the physical dimensions of the workpiece, the nature of the metalworking operation, convenience and cost.

In the context of the present invention, a combination of one or more metalforming lubricant(s) with one or more method(s) of application is termed a lubrication system.

It should be noted that there are several different fields of art within the broad area of metalforming arts. Forging, which is the context of the present invention, exists as hot forging, cold forging, isothermal forging, open die forging, closed die forging, press forging and hammer forging, etc. Other common metalforming operations include powder metallurgy, wire and tube drawing extrusion, rolling, heading, coining, sheet forming, and roll forming. By history and custom, the metalforming industry is highly fragmented; that is, firms doing business hi one of these types of metalforming tend to specialize in that one type of metalforming, to the exclusion of the other types of metalforming. Thus, one possessing ordinary skill hi one type of metalforming will not necessarily have ordinary skill in the other metalforming arts. This situation tends to limit the exchange of technical information among the different metalforming arts, and it also tends to limit the extent of obviousness therein.

Some of the teachings in the prior art relating to lubrication systems for forging processes are the following. Huet (U.S. Pat. No. 2,926,138) teaches the application of a paste comprising spherical glass and graphite particles in a vehicle of grease or oil to the forging tooling. In the context of the present invention, the term vehicle is taken to include liquids and liquefiable substances in which solids may be dissolved or suspended. Huet specifically teaches that the glass particles be spherical and comprised of a thermal insulator. Jacobs (U.S. Pat. No. 5,049,289) teaches a range of compositions for lubricants intended for facilitating assembly of threaded pipes and pipe fittings, and the sealing thereof against leakage. These lubricants are somewhat similar in composition to metalforming lubricants, but there is no teaching of the applicability to metalforming. Jain et al (U.S. Pat. Nos. 3,983,042, 4,104,178 and 4,287,073), Feneberger et al (U.S. Pat. No. 4,052,323) and Periard et al (U.S. Pat. No. 5,691,282) teach the use of suspensions of graphite powder in water, to which other ingredients have been added to stabilize the suspension, improve the performance of the lubricant, and for other purposes. Each of these patents teaches application of the lubricants to the die surfaces by spraying. Graham (U.S. Pat. No. 5,495,737) teaches the use of a lubricant mist comprising graghite particles and a vaporizable and polymerizable organic liquid, applied to either heated tooling or a heated workpiece. The prior art cited by Graham refers to application of forging lubricants by spraying, but Graham offers no specific method of application in his teaching.

Lubricants such as those described in the above-cited patents, or commercially available lubricants of generically similar formulations, are routinely employed in metalforming operations, particularly in hot forging of metallic workpieces. In spite of its inefficiency, spraying remains the most common method of application. During the development of the present invention it was estimated that in a typical process for applying a lubricant such as that disclosed by Jain, for each pound of graphite deposited on the die surfaces, roughly 40 pounds of material is discharged into the atmosphere. Some of this material is vaporized liquid carrier; some of it is a mixture of suspension or wetting agents, and the like; some of it is lubricant that is sprayed past the die surfaces. Further, the amount of lubricant employed is typically more than is necessary to provide proper lubrication, for operators of forging equipment often use excess lubricant to ensure that a finished forging does not stick in the die cavity. This approach is not unreasonable, because having a forging stick in the die cavity is, at best, a costly inconvenience in the operation of a forging shop.

However, this approach wastes a lot of lubricant, and it leads to deposits of excess lubricant in corners and depressions in the die cavity.

In 1971 Lomax, Jr. was granted a patent (U.S. Pat. No. 3,556,255) for electrostatic deposition of graphite onto the working surfaces of forging dies. However, the apparatus described by Lomax has not been widely accepted in the forging industry. It appears that Lomax's apparatus does not function as well in production as one might expect from the description in his patent. An explanation is found in a more recent patent by Inculet et al (U.S. Pat. No. 5,682,591), who state that "The lubricants that can be electrostatically sprayed in accordance with the present invention ideally have a low electrical conductivity . . . " It would appear that graphite, which is a very effective ingredient in forging lubricants, conducts electricity too well to be effectively applied to forging dies by electrostatic deposition.

The context of the invention by Inculet et al, and that of Fedrigo (U.S. Pat. No. 3,993,979) is applying lubricant to powder metallurgy dies. As metal powders are typically compacted at ambient temperature, the problems are somewhat different than encountered in forging and other metalforming operations. A principal reason for these differences is that powder metal compaction in press dies, the process described by Inculet et al, is typically performed at ambient temperature, where liquid petroleum or stearate lubricants are effective. By contrast, many forging operations are performed at elevated temperatures where such lubricants burn up. Further, the forging and powder metallurgy industries have been generally isolated from each other by the nature of the materials and workpieces, and by the historical development of the two industries. A somewhat similar approach of applying lubricant to a forming die was developed by Staniforth (U.S. Pat. No. 5,017,122) for use in producing pharmaceutical tablets. Inventions by Scholes et al (U.S. Pat. Nos. 4,073,966 and 4,221,185) disclose the use of electrostatic coating to apply lubricants to sheet metals prior to forming those materials in stamping and related manufacturing processes.

The gap between the application of lubricants by electrostatic deposition and the use of electrostatic deposition for applying lubricant to forging dies is the nature of the lubricant. If the lubricant is an organic or metallorganic material having poor electrical conductivity, such as zinc or magnesium stearate, or other waxy organic material, the electrostatic deposition process is effective. These materials are poor conductors of electricity. Graphite, which is particularly effective as a lubricant in hot forging operations, conducts electricity too well.

Many processes for coating a wide range of particulate materials with various coatings are known to those skilled in the art of microencapsulation. This is a mature art, widely used in many industries, such as the manufacture of pharmaceuticals, pesticides, "carbonless" paper and the like. One particular process for microencapsulation, taught by Smith-Johannsen et al (U.S. Pat. No. 3,992,558), employs a fluid energy mill for coating very small particles. Their process is directed toward particles smaller than 20 microns in diameter, and they present an example that describes the coating of particles only 0.03 microns in diameter. Thus, known coating and encapsulation technology includes methods for coating particles ranging from 0.03 microns to more than one millimeter in diameter.

SUMMARY OF THE INVENTION

It is an object of the present invention to provide an effective system for applying a suitable lubricating substance, or lubricant, to the working surfaces of tooling employed in forging and other hot forming operations used on metallic workpieces, or to the workpiece itself.

It is an object of the present invention to reduce the discharge of excess lubricant material into the atmosphere in the vicinity of forging presses, where such discharge is caused by the spraying of lubricant toward the working surfaces, and where a substantial amount of the lubricant is not deposited thereon. Such discharge is undesirable because of the waste of materials and because it represents atmospheric pollution in a metalforming plant.

It is an object of the present invention to reduce the accumulation of excess lubricant in internal corners and other depressions in the working surfaces of metalforming tools, where such accumulation can accentuate problems that may result when metal flowing in a die cavity does not fill that cavity.

It is an object of the present invention to minimize or completely avoid the use of volatile solvents in applying lubricants to working surfaces of metalforming tooling.

It is an object of the present invention to retain the effective lubrication characteristics of high temperature lubricants such as graphite for metalforming operations.

These and other objects of the present invention are achieved by a novel combination of widely divergent technologies. This combination provides an effective system for applying lubricants to working surfaces of metalforming tools, where the system comprises a novel form of lubricant and means for application thereof to Such working surfaces.

Those skilled in the art of forging recognize that graphite is one of the best lubricants for forging operations. Even where a lubricant is formulated with multiple active ingredients, graphite is typically included in the formulation. Those skilled in the arts of powder metallurgy and pharmaceutical manufacture have found that electrostatic deposition is an effective means of applying lubricant to die surfaces. Those skilled in the art of powder deposition of polymeric materials onto metallic substrates (in lieu of solvent-based paints) recognize that electrostatic deposition is very effective in that context. too. Those skilled in the art of microencapsulation have developed technologies for coating particulate materials with many different types of coatings. The present invention comprises the combination of microencapsulation lubricant particles applied to forging tooling or workpieces by electrostatic deposition.

Specifically, particles of solid lubricating substances, particularly graphite, are coated with a thin protective surface layer of a substance that is a poor conductor of electricity. The insulating coating allows graphite to be more effectively deposited by electrostatic deposition methods than is possible with bare graphite particles. The coating material may be a polymer substance that additionally serves as a binder to enhance adhesion of the lubricant particles to surfaces of forging dies. Particles of other ingredients, optionally coated with the same coating material used for coating the graphite particles, may be added to the lubricant. These particles comprise the particulate portion of the lubrication system. The application portion of the system comprises apparatus for electrostatic deposition of such particles onto the working surfaces of a set of metalforming tools. The system has been specifically developed for hot forging of metallic substrates, but it is also applicable to other metalforming processes.

DETAILED DESCRIPTION OF THE INVENTION

Figure 1:
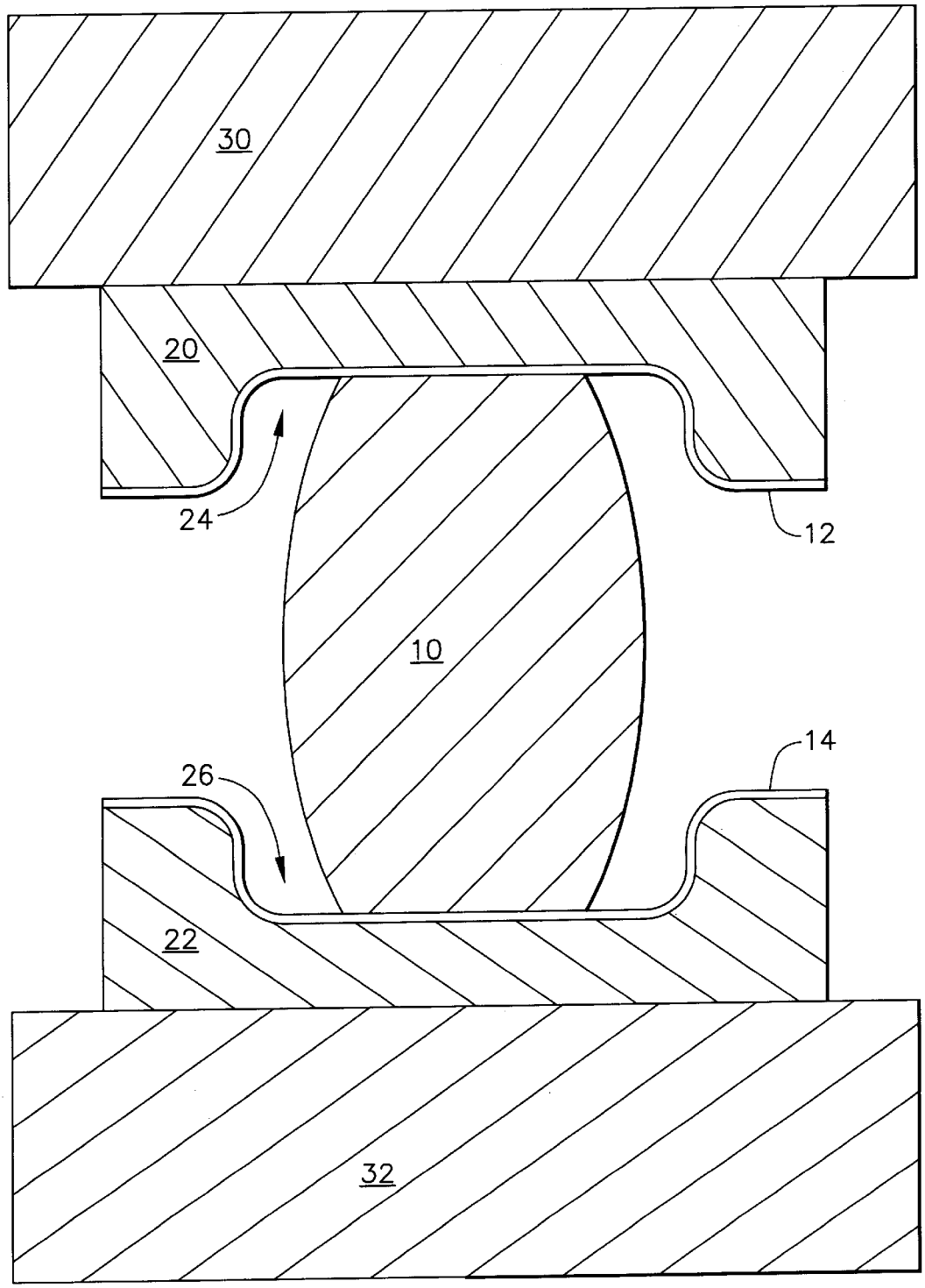
FIG. 1 illustrates, in schematic form, a hot forging process. Note that a layer of lubricant has been applied to the working surfaces of the forging dies prior to insertion of the preheated workpiece therebetween.

Key portions of a representative forging operation are shown schematically in FIG. 1. A workpiece 10 is deformed between two forging dies 20 and 22. The workpiece is typically comprised of a metallic material. Tile forging dies are supported and urged toward each other by forging equipment 30 and 32, which are not shown in detail. In one embodiment of forging equipment, what is shown at 30 and 32 are components of a hydraulic press; some forging presses can exert tens of thousands of tons of force on the workpiece 10. Under such a large force, the metal comprising the workpiece 10 is deformed to the point where its shape is largely determined by the shape of the die cavities 24 and 26 in the dies 20 and 22, respectively. The surfaces of the die cavities 24 and 26 that contact the workpiece 10 are sometimes termed working surfaces, or contact surfaces. The tern tooling is widely used in the forging industry to include forging dies, die support die members, and the like. The term generally includes all of the articles used in forging and related operations that are specific to the design of a particular product.

Various types of accessory equipment are routinely used in forging operations. These include means for preheating the workpiece 10, means for handling the workpiece, and means for subsequent cleaning and/or machining the workpiece, and the like. In the interest of simplicity and clarity, none of this accessory equipment is illustrated in FIG. 1. Also, there are many different types of forging equipment that are not illustrated herein. Likewise, the numerous other types of metalforming equipment are not shown herein. However, the present invention is fully applicable to other types of forging operations and such alternative metalforming processes.

The process of deforming the workpiece 10 requires that the metal must flow over the working surfaces of the die cavities 24 and 26. This material flow is typically accompanied by adhesive wear of the working surfaces of the die cavities, and sometimes by sticking of the workpiece to one or both dies. Adhesive wear of the working surfaces of the die cavities eventually results in loss of dimensional accuracy of the shape of the die cavities and a roughening of the working surfaces. Both of these phenomena are undesirable, because finished workpieces may fail to meet specifications, and because repair or replacement of the dies may be required. Sticking of a workpiece to a die requires an immediate halt to a forging operation. The steps needed to remove a forging from a die may include cooling all the apparatus shown in FIG. 1 to ambient temperature, removal of dies and workpiece from the forging press, destroying the workpiece to remove it from the dies, and refurbishing the dies for further service. Needless to say, a workpiece sticking in a die set is most undesirable, and forging dies and processes are specifically designed to prevent such occurrences.

It is well known in the forging industry that interposing a lubricant between the workpiece and the working surfaces of the forging dies can reduce both adhesive wear of the working surfaces of the die cavities and the occurrence of sticking. The use of a lubricant is shown in FIG. 1 at 12 and 14. This is an extremely difficult problem in the art of lubrication, primarily because of the high loads and high temperatures to which the lubricant is subjected. In general, liquid petroleum lubricants cannot perform acceptably under such conditions. Especially in hot forging operations, solid lubricating substances are typically employed. These include graphite, which is perhaps the most common, glass beads or frit, fluorocarbon compounds and polymers, molybdenum disulfide, boron nitride, various polymers and polymeric resins, halide salts, several types of boron compounds, and flakes of ductile metals such as copper. In the context of the present invention, any of these, or similar, lubricants may be termed active substances.

In some forging operations, the solid lubricant is applied to the workpiece. In some other forging operations, a solid lubricant may be applied to both the workpiece and the forging dies. As used herein, references to applying lubricant to forging dies, or forging tooling, mean applying such lubricants to working surfaces of the dies or tooling; application of lubricant to other surfaces of the dies or tooling is incidental.

Another aspect of a forging operation also points to the need for effective lubrication. That is the nature of the metallurgical structure resulting from the forging operation. The deformation that occurs during forging represents substantial working, or kneading, of the workpiece material. Even if the forging temperature is high enough so that recrystallization occurs during the forging operation, the metallurgical structure of the completed forging is invariably affected by the metal flow during forging. This is particularly apparent in regions of the workpiece that contacted the die surfaces at the beginning of the deformation. Referring to FIG. 1, such regions lie near the top and bottom surfaces of the workpiece 10. In the absence of effective lubrication, a condition called "die lock" occurs, and the metal does not slide over the die surface. Thus, there is virtually no deformation of the metal in the regions affected by the "die lock." Such a structure is generally deemed inferior to one having more uniform deformation during the forging process.

The effectiveness of any of these lubricants depends on the nature of the lubricant itself, but even more on how it is applied to the forging dies. An insufficient amount of lubricant applied over the entire working surfaces of the die cavities is only slightly better than no lubricant. It simply cannot perform acceptably. Thus, there is a tendency among workers in forging shops to err on the side of using an excess of lubricant, rather than risking insufficiency of lubrication. This tendency is wasteful, but the waste is deemed a necessary evil, for the consequences of insufficient lubrication are far more serious. In addition to the fact that lubricant is wasted, the places where the excess lubricant can be found represent an additional problem. The excess lubricant will likely accumulate in internal corners or depressions in the die cavities, thereby effectively altering the shapes thereof, or the excess lubricant may be discharged into the air in the forging plant.

As indicated above, graphite is a particularly effective lubricant for hot forging operations. It is also relatively inexpensive. Many different lubricants employing graphite as an important ingredient have been developed. Most of them have some sort of liquid vehicle, most commonly water or an organic oil or solvent. As indicated in the preceding description of the Background Art, additives such as wetting agents, suspension agents and stabilizers, thickeners, binders to secure the graphite flakes to working surfaces, biocides, and the like, may be incorporated into such lubricants. By far the most common method of applying such lubricants to the working surfaces of forging dies is spraying the lubricant onto the surfaces of the dies. Much of the sprayed lubricant material never reaches the working surfaces of the forging dies; this portion of the lubricant material, which may be termed overspray, is simply discharged into the air in the vicinity of a forging press. It may subsequently settle onto the floor, or the forging equipment, or in may be inhaled by workers in the forge shop. As none of these situations is desirable, there is additional incentive to minimize overspray of the lubricant material.

The process of electrostatic deposition is widely used in the metal finishing industry to apply polymeric coatings to metallic substrates. It is an attractive option in this industry because it does not require the vehicles or volatile solvents employed in paints; such solvents are undesirable from the perspective of atmospheric pollution. That advantage has been retained in the present invention. The process and the equipment utilized in electrostatic deposition have been well developed in the industry. This technology has been adapted to application of lubricants in powder metallurgy processing, as described by Inculet et al (U.S. Pat. No. 5,682,591, in column 3, line 25, through column 4, line 39), which description is incorporated herein by reference. The lubrication problem in the compaction portion of powder metallurgy processing is substantially different from that in forging, so that liquid lubricants unsuitable for forging may be appropriate for powder metallurgy. This is why adaptation of the technology described by Inculet et al to forging required considerable developmental work.

Several important considerations taught by Inculet et al are the preferred size range of lubricant droplets or particles, the need for good electrical conductivity of the tooling material, and the need for poor electrical conductivity of the lubricant droplets or particles. They teach that the droplets or particles of lubricants are preferably less than 100 microns in diameter, more preferably less than 50 microns, and most preferably less than 15 microns. However, the encapsulation process employed in the present invention favors somewhat larger lubricant particles, perhaps as large as 500 microns in diameter. Although encapsulation processes can be effective on substrate particles as small as one micron, specifying such a small particle size raises the cost of encapsulation and requires a larger amount of encapsulating material. In the context of the present invention, the preferred range of lubricant particle diameters is in the 20–100 micron range.

In the context of the present invention, terms referring to electrical conductivity are relative. Inculet et al disclose the requirement that the die material be "at least partially conducting." In practical terms, the die material must conduct electricity well enough so that any portion of the surface of the die not previously covered with a layer of lubricant particles must be at electrical ground potential, as the electrostatic deposition apparatus is typically employed. Commonly used die materials, including tool steels, superalloys and cemented carbides, meet this requirement. Terms such as "good" or "high" electrical conductivity are used herein in describing such materials. Inculet et al also teach that the electrical conductivity of the lubricant droplets or particles must be low enough ". . . so that the [electrical] charges are retained in the deposited droplets or particles for a sufficient period of time to ensure adherence to the die wall surfaces." Terms such as "poor" or "low" electrical conductivity are used herein to refer to this type of material. Although Inculet et al include graphite in their list of suitable dry lubricants, work leading to the present invention suggests that it should not have been included in that list. Thus, in the present invention, graphite particles are encapsulated in a material having poor electrical conductivity. Some of the categories of materials deemed suitable for encapsulated coatings are shellacs, starches, dextrin, zein and tackifier resins. Tile tackifier resins, or other thermoplastic materials, are believed to be preferable as providing good adhesion of the particles to a hot forging die. As the coatings described herein may have additional properties that serve to protect the graphite particles from oxidation or other hazards, coatings employed in the present invention may be termed protective layers, to emphasize the broader functionality thereof.

Work to date suggests that it is not necessary to cover the entire surface of every lubricant particle with the protective coating to achieve the beneficial results described herein. Thus, in the context of the present invention, whether or not the particles are completely covered by a protective layer is deemed immaterial. However, substantially complete coverage represents a preferred embodiment of the present invention.

Research leading to the present invention indicated that applying graphite powder to the working surfaces of forging dies by electrostatic deposition has been an elusive dream. Even though the concept has been known for more than 27 years, after the disclosure by Lomax, Jr. in 1971 (U.S. Pat. No. 3,556,255), the process has not achieved commercial success. Producers of commercial electrostatic deposition apparatus have worked with many potential customers, but the results have been disappointing. Research leading to the present invention indicated that the missing ingredient in this process has been some means of making the graphite particles retain an electric charge long enough to be attracted to the working surfaces of the die cavities. That missing ingredient has been provided in the present invention, by covering the graphite particles with a protective surface layer, or coating, of a substance having poor electrical conductivity, through the process of microencapsulation.

Although the graphite particles used in work leading to the present invention were coated in a laboratory setting, it is believed that many firms in the business of microencapsulation could coat graphite flakes with a suitable coating, as microencapsulation is a mature commercial process. Similarly, it is believed that virtually any of the commercially available electrostatic deposition equipment will perform acceptably in the context of the present invention.

Numerous other embodiments of the present invention have been contemplated. For example, other lubricants may be employed, in addition to the lubricant encapsulated in the protective coating. The additional lubricants may be any of the solid lubricant materials listed above, in particulate or powdered form. Where the additional lubricants have poor electrical conductivity, the use of a protective coating layer is optional. However, where the additional lubricant has good electrical conductivity, such as flakes of copper, the particles thereof are advantageously coated with the same material as the graphite particles, or a similar material.

Because liquid or semi-solid lubricants that might otherwise be included in the lubricant system might cause clumping of the coated graphite particles, such substances might be prepared as droplets enclosed by a solid coating. This technology is known in the art of microencapsulation, and it is routinely used in applications such as multi-copy printed forms made of "carbonless" pressure-sensitive paper. Such a configuration can minimize or eliminate the evaporation of such substances prior to application onto the forging tooling. Likewise, substances that might react with each other can be kept separate until applied to the metalforming tooling by separate microencapsulation of each. In the context of the present invention, these substances, and the additional lubricants described above, may be termed active substances.

Another embodiment of the present is that of multiple layers applied to lubricant materials by microencapsulation. For example, lubricant particles would be first coated by an active substance, and the coated particles would be coated again by a protective layer. In this manner, the lubricant system would necessarily provide the deposition of an appropriate relative amount of each component of the system with the deposition of each individual particle.

Another embodiment of the present is the addition of other active substances to the lubricating system. For example, substances that lessen oxidation or corrosion to either forging dies or workpieces may be included. Also, substances that retard the flow of heat from the workpiece to the forging dies may be included. The term active substance is applied to these substances, even though they might not be classified as lubricating substances. Through the selection of such other active substances and/or multilayer lubricant particles, lubrication systems can be formulated specifically for the needs of particular metalforming operations and particular workpiece materials. In effect, lubricant systems can be specifically tailored for conditions such as die or workpiece temperature, forging loads, extent of metal flow, and other such parameters. Also, different lubricant formulations can be applied to different regions of the die surfaces, or to the workpiece surface.

Yet another embodiment of the present invention is the application of lubricant materials to a workpiece prior to deformation in a metalforming operation. Compared to other lubrication systems used in this context, the present invention provides for less wasteful application of lubricant materials.

Although the present invention has been described with reference to certain preferred embodiments, it will be appreciated that the present invention is not limited thereby. Those skilled in the art will recognize that minor variations and modifications in the system for providing lubrication in metalforming operations, as described herein, still lie within the spirit and scope thereof, and such variations and modifications properly fall within the scope of the present invention, which is defined by the following claims.

I claim:

1. A system for providing lubrication in a metalforming operation, comprising:

lubricant particles, each particle comprising a particle of lubricating substance substantially completely covered by a protective layer of a substance that is a poor conductor of electricity, said protective layer being applied to said lubricant particles by an encapsulation process; and electrostatic deposition means for applying said lubricant particles to working surfaces of tooling employed in said metalforming operation;

wherein said lubricant particles comprise a range of sizes extending from about one micron to about 500 microns; and wherein said protective layer is sufficiently thick and sufficiently complete to maintain an electrostatic charge on each particle during electrostatic deposition of said lubrication particles on said working surfaces.

2. The system for providing lubrication as recited in claim 1, wherein said lubricating substance is graphite.

3. The system for providing lubrication as recited in claim 1, wherein said protective surface layer is a polymer substance.

4. The system for providing lubrication as recited in claim 3, wherein said polymer substance is a thermoplastic substance.

5. The system for providing lubrication as recited in claim 1, wherein said system is essentially free of vehicles.

6. The system for providing lubrication as recited in claim 1, wherein said lubricant particles each comprise a particle of lubricating substance, first covered by at least one layer of active material and then by a protective surface layer.

7. The system for providing lubrication as recited in claim 1, wherein said system additionally comprises particles of an active substance.

8. The system for providing lubrication as recited in claim 7, wherein said particles of an active substance are coated with a protective surface layer.

9. The system for providing lubrication as recited in claim 1, wherein said range of sizes extends from about 20 microns to about 100 microns.

10. The system for providing lubrication as recited in claim 9, wherein said protective surface layer is a glass.

11. The system for providing lubrication as recited in claim 9, wherein said protective surface layer is a glass.

12. A system for providing lubrication in a metalforming operation, comprising:

(a) lubricant particles, each particle comprising a particle of lubricating substance substantially completely covered by a protective layer of a substance that is a poor conductor of electricity, said protective layer being applied to said lubricant particles by an encapsulation process; and (b) electrostatic deposition means for applying said lubricant particles to a workpiece prior to deformation thereof in said metalforming operation;

wherein said lubricant particles comprise a range of sizes extending from about one micron to about 500 microns; and wherein said protective layer is sufficiently thick and sufficiently complete to maintain an electrostatic charge on each particle during electrostatic deposition of said lubrication particles on said workpiece.

13. The system for providing lubrication as recited in claim 12, wherein said lubricating substance is graphite.

14. The system for providing lubrication as recited in claim 12, wherein said protective surface layer is a polymer substance.

15. The system for providing lubrication as recited in claim 14, wherein said polymer substance is a thermoplastic substance.

16. The system for providing lubrication as recited in claim 12, wherein said system is essentially free of vehicles.

17. The system for providing lubrication as recited in claim 12, wherein said lubricant particles each comprise a particle of lubricating substance, first covered by at least one layer of active material and then by a protective surface layer.

18. The system for providing lubrication as recited in claim 12, wherein said system additionally comprises particles of an active substance.

19. The system for providing lubrication as recited in claim 18, wherein said particles of an active substance are coated with a protective surface layer.

20. The system for providing lubrication as recited in claim 12, wherein said range of sizes extends from about 20 microns to about 100 microns.

* * * * *

UNITED STATES PATENT AND TRADEMARK OFFICE

CERTIFICATE OF CORRECTION

PATENT NO. : 6,330,818 B1
DATED : December 18, 2001
INVENTOR(S) : Sulekh Chand Jain It is certified that error appears in the above-identified patent and that said Letters Patent is hereby corrected as shown below:

Column 1,
Line 59, delete “hi” and insert -- in -- in place thereof.

Column 2,
Line 10, delete “hi” and insert -- in -- in place thereof.
Line 13, delete “hi” and insert -- in -- in place thereof.
Line 33, a new paragraph should begin with the sentence beginning “Jain et al . . .”.

Column 4,
Line 29, delete “Such” and insert -- such --.
Line 44, delete “microencapsulation” and insert -- microencapsulated --.

Column 5,
Line 9, “Tile” and insert -- The --.

Column 8,
Line 2, please delete “Tile” and insert -- The --.

Column 9,
Line 44, delete “lubricant” and insert -- (a) lubricant -- in place thereof.
Line 50, delete “electrostatic” and insert -- (b) electrostatic -- in place thereof.

UNITED STATES PATENT AND TRADEMARK OFFICE

CERTIFICATE OF CORRECTION

PATENT NO. : 6,330,818 B1
DATED : December 18, 2001
INVENTOR(S) : Sulekh Chand Jain It is certified that error appears in the above-identified patent and that said Letters Patent is hereby corrected as shown below:

Column 10,
Lines 19 - 20, please delete “claim 9” and insert -- claim 19 -- in place thereof.
Line 21, please renumber Claim 12 to be Claim 11.
Line 40, please renumber Claim 13 to be Claim 12.
Line 41, please delete “claim 12” and insert -- claim 11 -- in place thereof.
Line 42, please renumber Claim 14 to be Claim 13.
Line 44, please delete “claim 12” and insert -- claim 11 -- in place thereof.
Line 46, please renumber Claim 15 to be Claim 14.
Line 47, please delete “claim 14” and insert -- claim 13 -- in place thereof.
Line 49, please renumber Claim 16 to be Claim 15.
Line 50, please delete “claim 12” and insert -- claim 11 -- in place thereof.
Line 51, please renumber Claim 17 to be Claim 16.
Line 52, please delete “claim 12” and insert -- claim 11 -- in place thereof.
Line 56, please renumber Claim 18 to be Claim 17.
Line 57, please delete “claim 12” and insert -- claim 11 -- in place thereof.
Line 60, please renumber Claim 19 to be Claim 18.
Line 61, please delete “claim 18” and insert -- claim 17 -- in place thereof.
Line 63, please renumber Claim 20 to be Claim 19.
Line 64, please delete “claim 12” and insert -- claim 11 -- in place thereof.

Signed and Sealed this

Twelfth Day of November, 2002

*Attest:*

*Attesting Officer*

JAMES E. ROGAN
*Director of the United States Patent and Trademark Office*